US006581343B1

(12) United States Patent
Metelli

(10) Patent No.: US 6,581,343 B1
(45) Date of Patent: Jun. 24, 2003

(54) PREFABRICATED GIRDER IN TWO HALVES AND ROOF STRUCTURE

(76) Inventor: Luigi Metelli, Via Fabbrichetta 3, I-25033 Cologne (IT)

( * ) Notice: Subject to any disclaimer, the term of this patent is extended or adjusted under 35 U.S.C. 154(b) by 0 days.

(21) Appl. No.: 09/806,979

(22) PCT Filed: Aug. 2, 2000

(86) PCT No.: PCT/IT00/00328

§ 371 (c)(1),
(2), (4) Date: Jun. 18, 2001

(87) PCT Pub. No.: WO01/11159

PCT Pub. Date: Feb. 15, 2001

(30) Foreign Application Priority Data

Aug. 5, 1999 (IT) ..... BS99A0079

(51) Int. Cl.[7] ..... E04C 3/20; E04C 3/02

(52) U.S. Cl. ..... 52/223.9; 52/81.3; 52/82; 52/223.11; 52/282; 52/253; 52/583.1; 52/724.1; 403/170; 403/301; 403/370

(58) Field of Search ..... 52/80.1, 81.2, 52/81.3, 82, 223.9, 223.11, 282.2, 583.1, 724.1, 726.2, 253; 403/299, 294, 301, 302, 370, 169, 170, 171, 180, 217, 292

(56) References Cited

U.S. PATENT DOCUMENTS

| | | | | | |
|---|---|---|---|---|---|
| 872,726 | A | * | 12/1907 | Grady | 52/250 |
| 1,037,416 | A | * | 9/1912 | Beverstock | 256/19 |
| 2,920,475 | A | * | 1/1960 | Graham | 249/13 |
| 3,224,151 | A | * | 12/1965 | Nystrom | 52/639 |
| 3,369,334 | A | * | 2/1968 | Berg | 52/223.13 |
| 3,465,484 | A | * | 9/1969 | Zaldastani et al. | 52/127.1 |
| 3,593,477 | A | * | 7/1971 | Briggs | 52/253 |
| 3,785,095 | A | * | 1/1974 | Verner | 52/125.6 |
| 4,041,659 | A | * | 8/1977 | McElhoe | 52/639 |
| 4,275,534 | A | * | 6/1981 | Porter | 52/653.1 |
| 4,612,751 | A | * | 9/1986 | Gloppen et al. | 52/250 |
| 4,720,947 | A | * | 1/1988 | Yacaboni | 52/167.1 |
| 4,781,006 | A | * | 11/1988 | Haynes | 52/583.1 |
| 4,784,172 | A | * | 11/1988 | Yacoboni | 135/87 |
| 5,088,245 | A | * | 2/1992 | Anderson | 403/251 |
| 5,826,384 | A | * | 10/1998 | O'Neill | 52/223.1 |

FOREIGN PATENT DOCUMENTS

| | | | | |
|---|---|---|---|---|
| CA | 994513 | * | 8/1976 | 52/223.9 |
| DE | 2035426 A | * | 8/1971 | 52/223.11 |
| FR | 356960 | * | 3/1906 | 52/227 |
| GB | 869696 | * | 6/1961 | 52/583.1 |
| GB | 877467 A | * | 9/1961 | 52/583.1 |
| SU | 1260466 | * | 9/1986 | 52/208 |

* cited by examiner

*Primary Examiner*—Carl D. Friedman
*Assistant Examiner*—Brian E. Glessner
(74) *Attorney, Agent, or Firm*—McGlew and Tuttle, P.C.

(57) ABSTRACT

The invention concerns a girder in reinforced concrete that has a flat intrados (11) and a flat or sloping extrados (12), which consists of two symmetrical halves or girders (13, 14) with adjacent parts that meet in a plane mid-way (15), perpendicular to the intrados, and equipped, near the extrados (12), with connecting plates for bolting (16) and, near the intrados (11), with a joint device (17) that has bars which are parallel to the intrados.

9 Claims, 10 Drawing Sheets

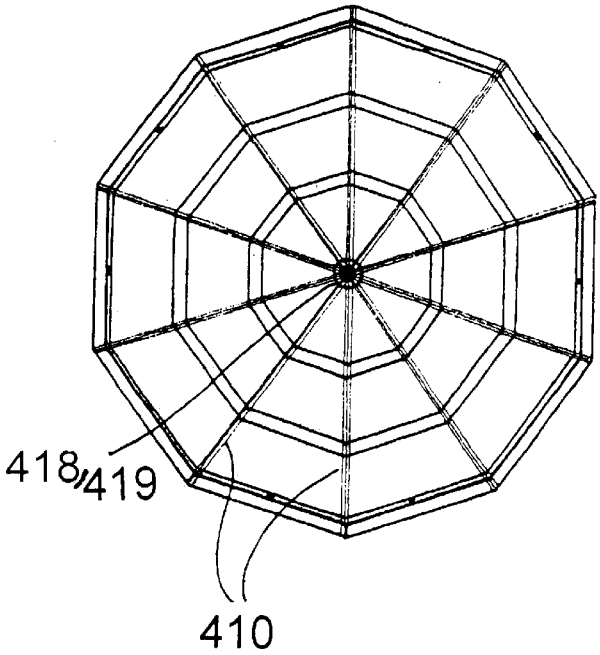
Fig. 12
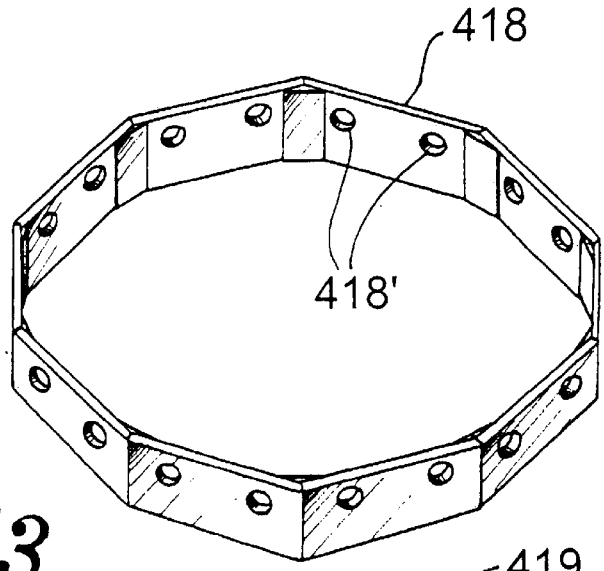
Fig. 13
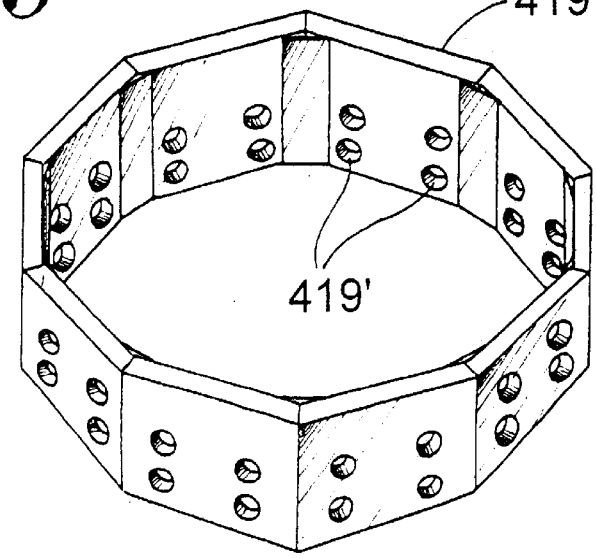

PREFABRICATED GIRDER IN TWO HALVES AND ROOF STRUCTURE

FIELD OF THE INVENTION

This invention regards made from vibrated or pre-stressed reinforced concrete and, in particular, refers to a prefabricated girder in two halves to the means for joining the two halves together statically at the moment of using the girder, as well as a roof structure made from such girders, for buildings with a circular, polygonal or elliptical plan, both for civil and industrial use.

STATE OF THE ART

According to the techniques available, pre-fabricated girders in reinforced concrete, including those with a flat, T-shaped or H-shaped intrados, have, so far, been made in a single piece, using an unbroken metal reinforcement, even when consisting of remarkable length. However, when they are particularly long, their construction requires moulds which are extremely cumbersome and difficult. Furthermore, transporting such girders becomes awkward as a result of their size and weight. Road transportation can also be problematic where the roads are narrow or in the mountains, especially when special transport vehicles are called for.

INFORMATION ABOUT THE INVENTION

One aim of this invention is to propose a girder, in particular with a flat intrados, consisting of two symmetrical halves and where the two halves are connected by a joint device which ensures similar resistance and static characteristics to those girders made in a single piece.

Another aim of the invention is to create a girder with a flat intrados and a flat or sloping extrados, which will have the advantage of using less cumbersome moulds for its construction, for simpler casting, easier manoeuvrability and transportation, even in difficult circumstances and with girders of notable length, giving girders of a length which have been very uncommon to date and, finally, reducing production and transportation costs of said girders.

A further aim of the invention is to create reinforced concrete girders, with a T-shape or H-shape, in two symmetrical halves that can be joined together at the moment when the girder is employed at its final site, where there will also be the advantages of facilitating manoeuvring and transportation, without having recourse to special vehicles.

Yet another aim of the invention is to propose a roof structure with a circular, polygonal elliptical or similar plan, consisting of half-girders which are pre-fabricated in reinforced concrete, easily transportable, converging and connected in a simple and secure way at the moment of erecting, by the simple process of screwing together the joint devices.

Consequently, the invention proposes a girder in vibrated or pre-stressed reinforced concrete, consisting of two opposing symmetrical halves, where the adjacent parts match together in a plane which is perpendicular to the intrados of the girder, and which are equipped, near to the extrados, with plates that connect using bolts and, near to the intrados, with a joint device with rods.

Likewise, the invention proposes a roof structure for buildings with a circular, polygonal, elliptical or similar structure, consisting of numerous half-girders, each with a near end and a far end (12), incorporating longitudinal connecting rods, each of which have a threaded end that protrudes from the near end, and of means for connecting the near ends of the half-girders at the level of the threaded ends of the connecting rods, using safety nuts, while the far ends of the half-girders rest on pillars or other supports.

BRIEF DESCRIPTION OF THE DRAWINGS

The enclosed drawings illustrates various examples of the girder and the roof structure according to the invention, and these will be described in detail below, making reference to the enclosed drawings where:

FIG. 12 shows a plan of the layout of the girders in a roof structure with a polygonal plan;

FIG. 13 show the ring elements for connecting several girders which converge radially;

DETAILED DESCRIPTION OF THE INVENTION

Figure 1:
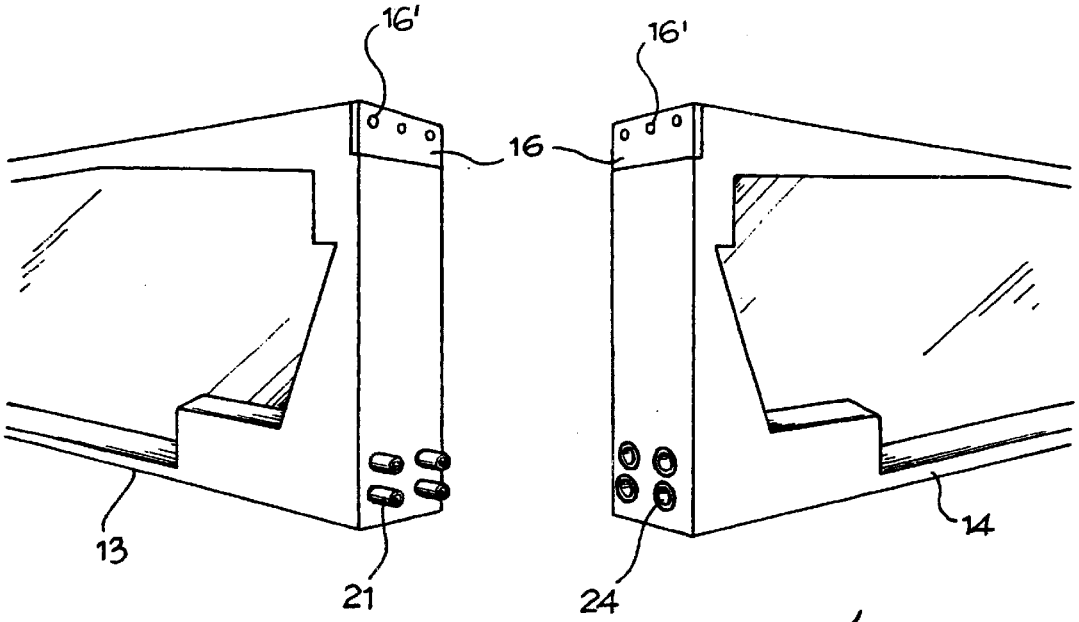
FIG. 1 shows the two separate halves or half-girders of a single girder, according to a preferred version.
Figure 1A:
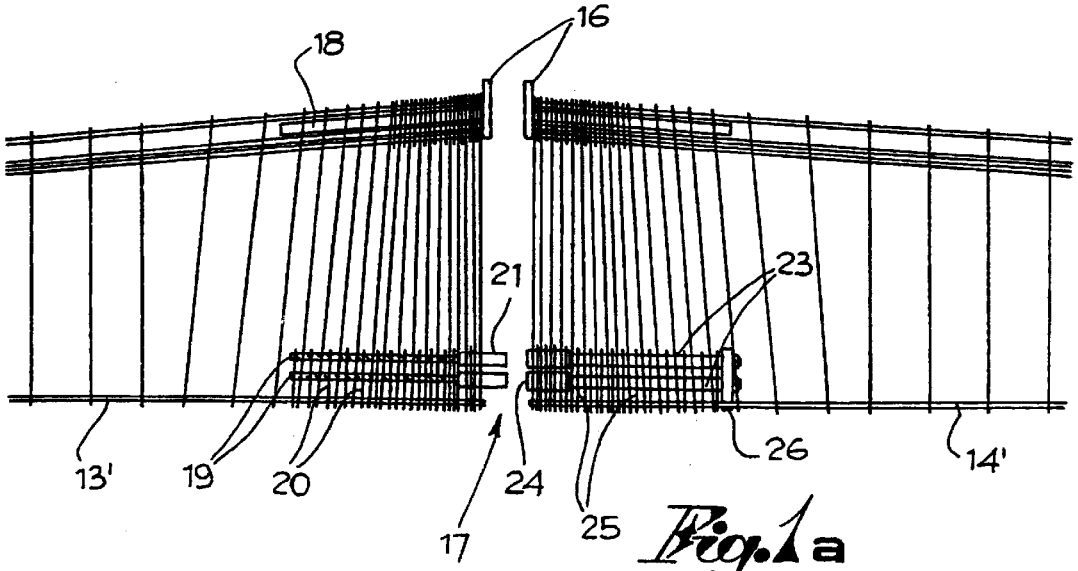
FIG. 1*a* shows part of the reinforcement of the half-girders.

The girder shown in FIGS. 1–5 is of the type with a flat intrados 11 and a flat or sloping extrados 12. It consists of two symmetrical halves or half-girders 13, 14, with adjacent parts that match on an intermediate plane 15, perpendicular to the intrados.

The two halves or half-girders 13, 14 are made in their respective moulds, string from their own reinforcements 13', 14', respectively, and adding to that end of each one which is designed to match with the neighbouring face of the other halt a connecting plate 16, which is near to the extrados, and a joint device 17, which is near to the intrados.

In each half-girder 13, 14—FIG. 1—the connecting plate 16 is anchored to the ordinary reinforcement 13', 14' by means of a series of reinforcing bars 18 and has holes 16' for housing two tightening bolts.

The joint device 17 near the intrados can be made in a variety of ways.

Figure 2:
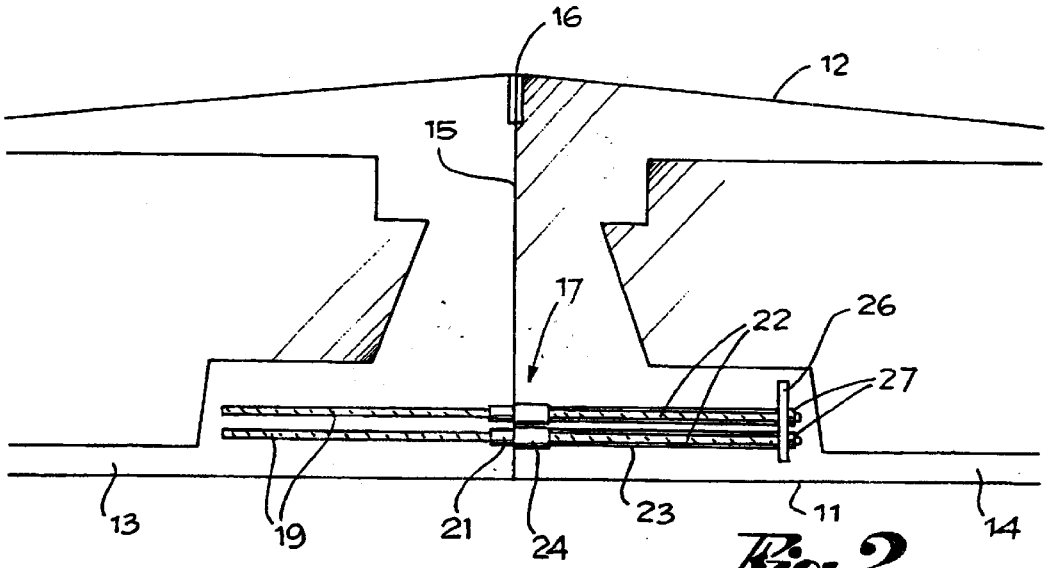
FIG. 2 shows the two half-girders of FIG. 1 joined together, seen from the front and in cross-section.
Figure 3:
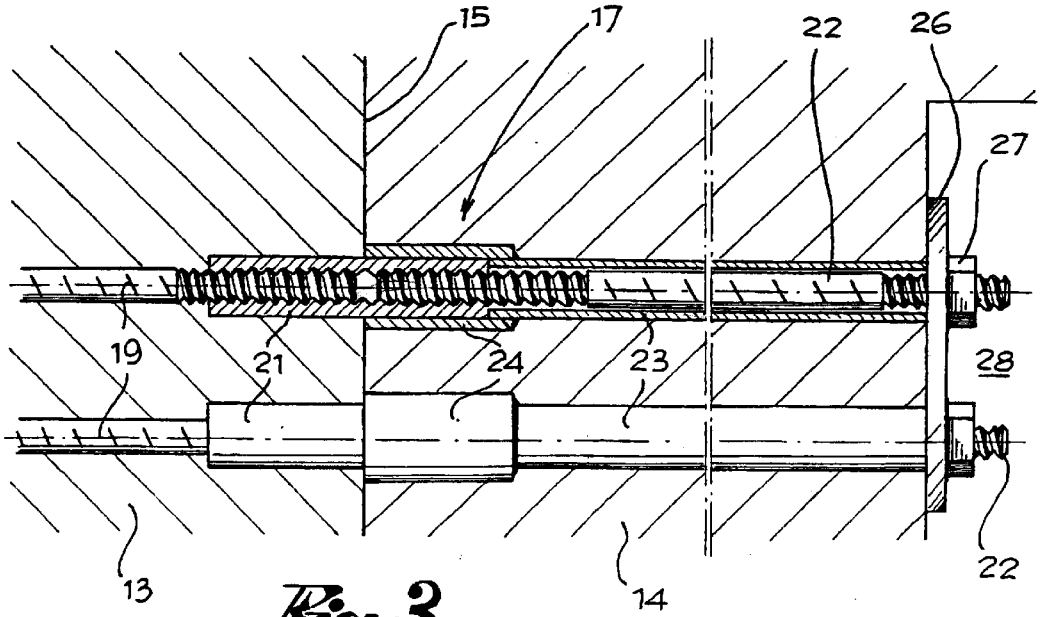
FIG. 3 shows an enlarged detail of a joint device for the two half-girders in FIG. 1.

In one of the versions, as shown in FIGS. 1–3, a first half-girder 13 has, on both front and rear sides, at least one, or preferably more, strong metal bars 19, parallel to the intrados 11. These are linked to the ordinary reinforcement 13' of the half-girder itself by means of stirrups 20 and each of them ends in a sleeve 21, which is threaded internally and protrudes slightly from one side of the half-girder to the facing half-girder 14.

This second half-girder 14 also consists of a similar number of second strong metal bars 22, which, however, are each inserted or guided inside a tubular lining 23 and a coupling tube 24, which are aligned and fastened to the reinforcement 14' of said second girder by means of stirrups. The coupling tubes 24 face and are designed to house the protruding part of the corresponding sleeves 21 of the first half-girder. At the opposite ends from the coupling tubes 24, the tubular linings have a blocking plate 26, while the opposite ends of the second bars 22 are threaded so that they can be screwed into the sleeves 21 on one side and so that a tightening nut 27 can be applied to the other, the nut resting against the blocking plate.

At the star the two half-girders are separate and transported that way for ease of transport and to reduce the length.

They are joined together at the moment when the girder is actually needed. The two half-girders are brought together in their matching plane 15.

The connecting plates 16 near the extrados are fixed together using the respective bolts. The sleeves 21 of the first half-girder 13 are housed in the tubes of the second half-girder 14. The second bars 22, which are fitted inside the tubular linings 23, are screwed into place with one of their ends in said sleeves 21; at the opposite ends of said bars, the tightening nuts 27 are turned until they obtain the blockage required. It should be noted that the second bars 22 and the tightening nuts 27 are accessible via a cavity 28, located on each side of the girder. This cavity is subsequently filled in, once the assembly and tightening are complete.

Figure 4:
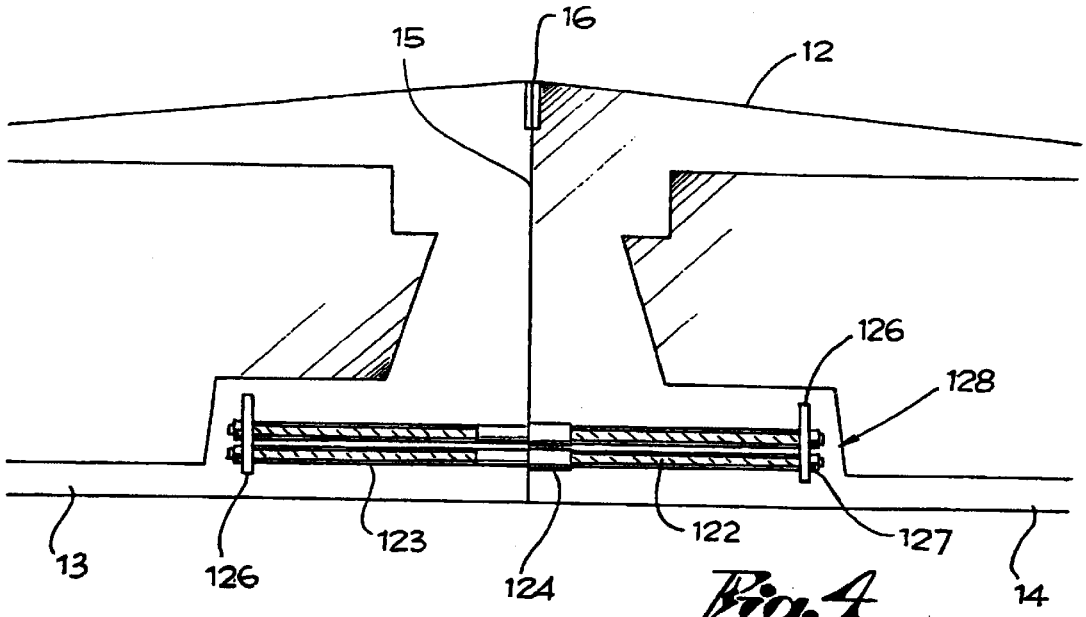
FIG. 4 shows another example of a girder in two halves, with a different joint system.

In another version—FIG. 4—the half-girders 13, 14 both incorporate, at the level of the extrados, a further two connecting plates 16, to be fastened together with bolts. Near the intrados, each half-girder, however, has a tubular lining 123 with a coupling tube 124. When the two half-girders are brought together for joining, their tubular elements 123, 124 are lined up and through them there pass the high-resistance joint bars 122, which are in one piece and have threaded ends on which there are mounted tightening nuts 127; the latter rest against the blocking plates 126 and are accessible via cavities 128 in the half-girders.

Figure 5:
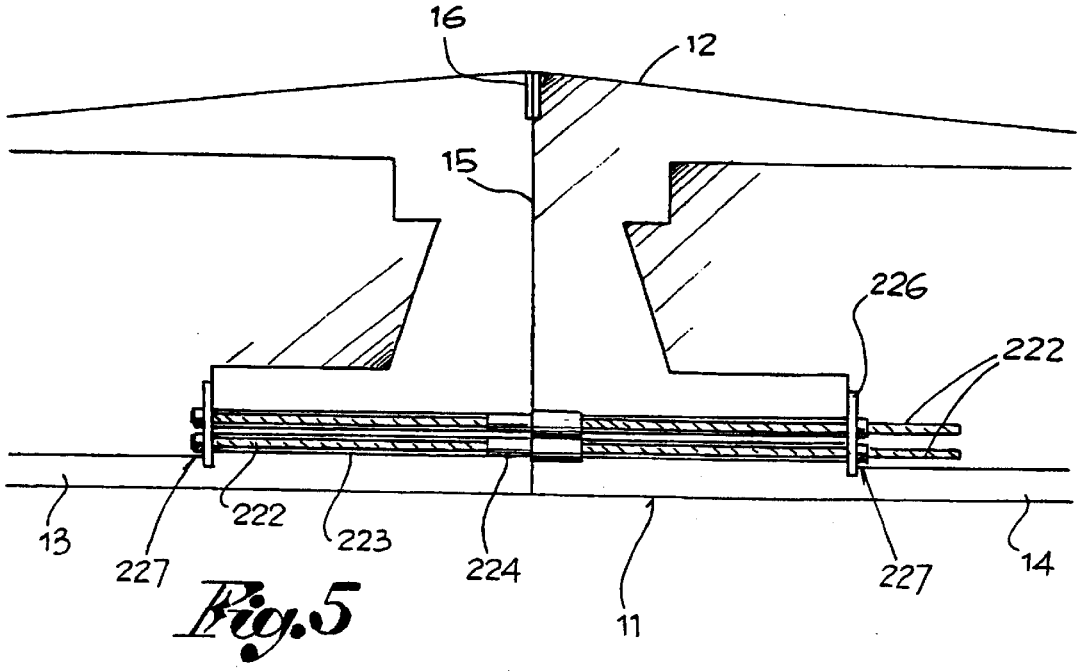
FIG. 5 shows a further example of a girder in two halves, which differs in its joint device.

In another variation—FIG. 5—the two half-girders 13, 14 also have connecting plates 16 with bolts at the level of the extrados, as in the previous cases, and near to the intrados of the tubular elements 223, 224 for the passage of stranded cords 222, anchored at one end to a plate 226 and tautened at the other end by means of cone-shaped clamps 227, to give a girder which is assembled after tautening.

Figure 6:
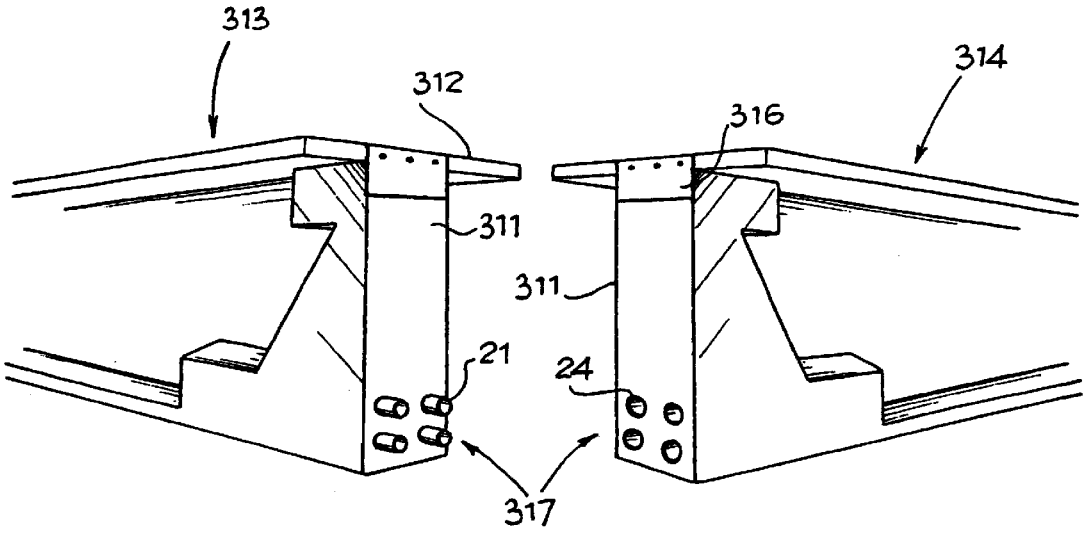
FIG. 6 shows parts of T-shaped half-girders, facing one another but still separate.

The girder in FIG. 6 is T-shaped, that is, it has two outstretched wings, with a rib 311 at the intrados and a still 312 on the extrados. It consists of two symmetrical halves or half-girders 313, 314, with adjacent ends that meet in a vertical plane 315.

The two half-girders 313, 314 are made in their respective moulds, starting from their own reinforcements—not shown—and with the addition, at the end of each one that is intended to join with its neighbour, of a connecting plate 316, near to the extrados, and a joint device 317, near the intrados.

Figure 7:
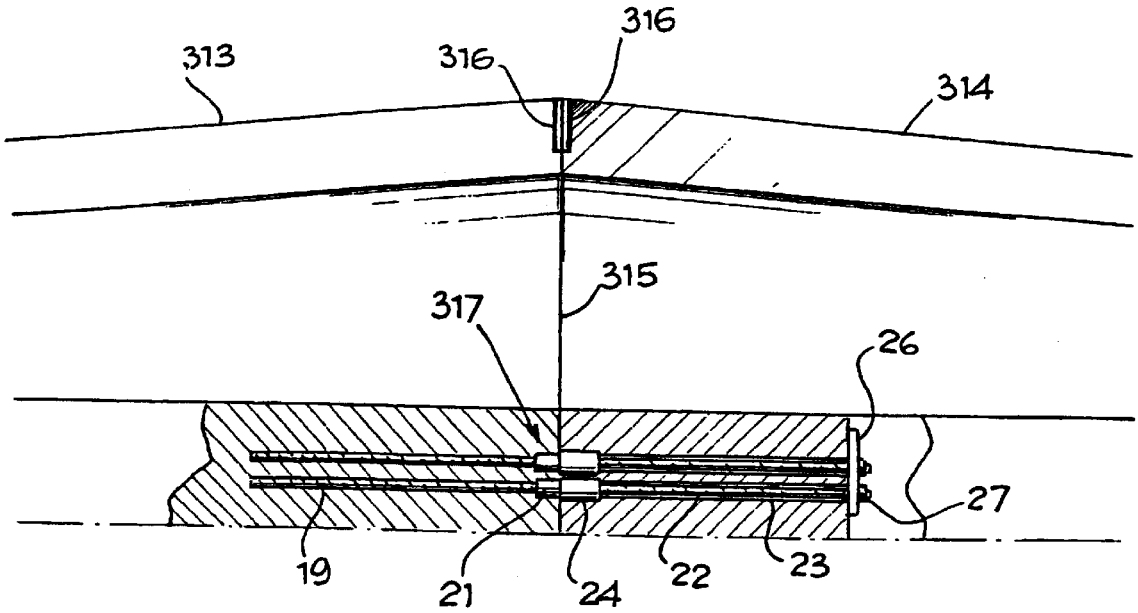
FIG. 7 shows, from the front and in cross-section, the parts of the two half-girders in FIG. 6, joined by a device similar to that in FIG. 2.

In both the half-girders 313, 314, the connecting plate 316 and the joint device 317 may be of the type described above and shown in FIG. 2, therefore the same components are indicated in FIGS. 6 and 7 with the same reference numbers as used in FIG. 2.

Figure 8:
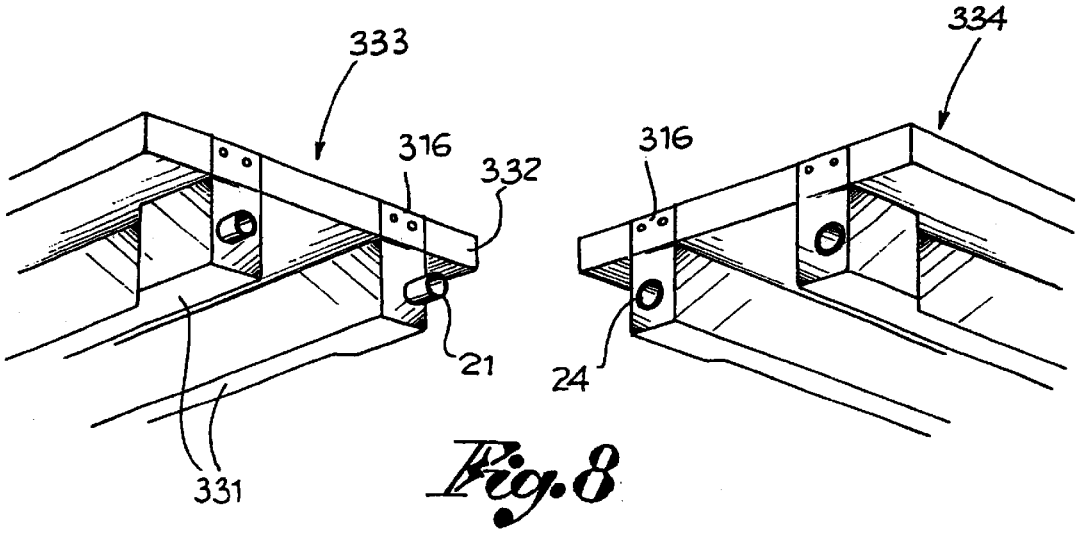
FIG. 8 shows parts of two T-shaped half-girders which are still separate.

The girder in FIG. 8 is H-shaped, with two parallel ribs 331 at the intrados and a sill 332 on the extrados. This girder also consists of two sing and symmetrical half-girders 333, 334, with adjacent ends meeting in a central vertical plane when the two half-girders are brought together and joined. The joint of the two half-girders 333, 334 is made using means that are identical to those used for the half-girders 313, 314 which formed the girder in FIG. 6. In FIG. 4, identical or equivalent means to those described in FIGS. 6 and 7 are indicated by the same reference numbers. Likewise, the two half-girders 333, 334 are connected by means of plates 316, fastened with bolts at the level of the sill on the extrados, and by means of the coupling of sleeves 21 with the tubes 24 facing them, near the extrados and present in both ribs 331 of the half-girders.

The two half-girders 313, 314; 333, 334 are originally separate and are sorted in that way to ensure case of transport and reduced length. They are joined together when the girder is actually required. At that moment, the two half-girders arm brought together in the central meeting plane. The connecting plates 316, near the extrados, are fixed together by means of their respective bolts. The sleeves 21 of the first half-girder 313, 333 are housed in the tubes 24, of the second half-girders 314, 334. The second bars 22, which are inserted into the tubular linings 23, are screwed at one end into said sleeves 21; at the other end of said bars, the tightening nuts 27 are turned until the give the blockage required.

Figure 9:
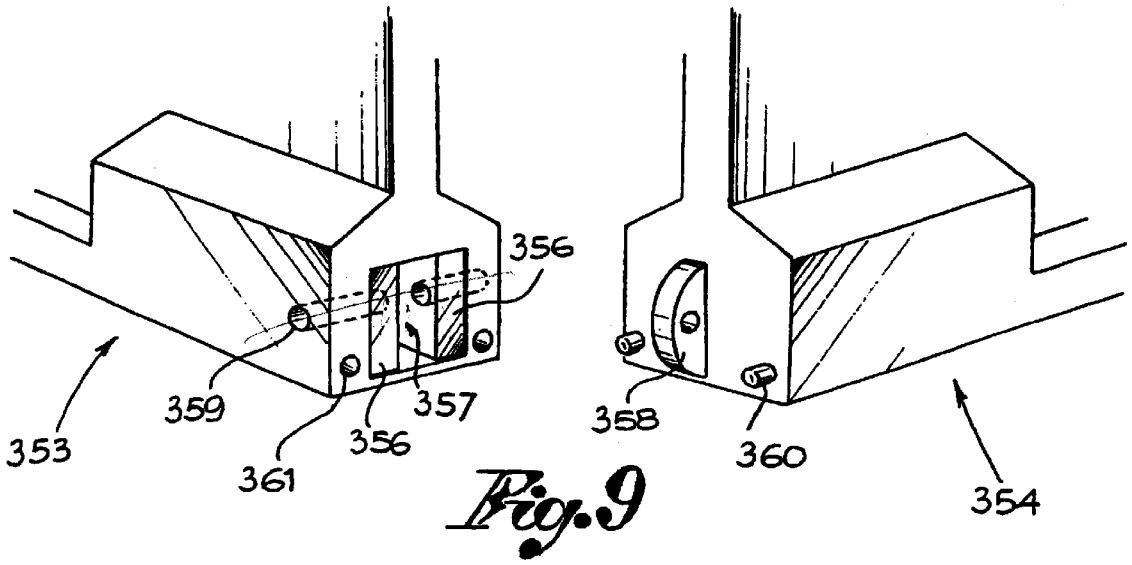
FIGS. 9 and 10 show another example of means for joining together two half-girders, in perspective and in cross-section.
Figure 10:
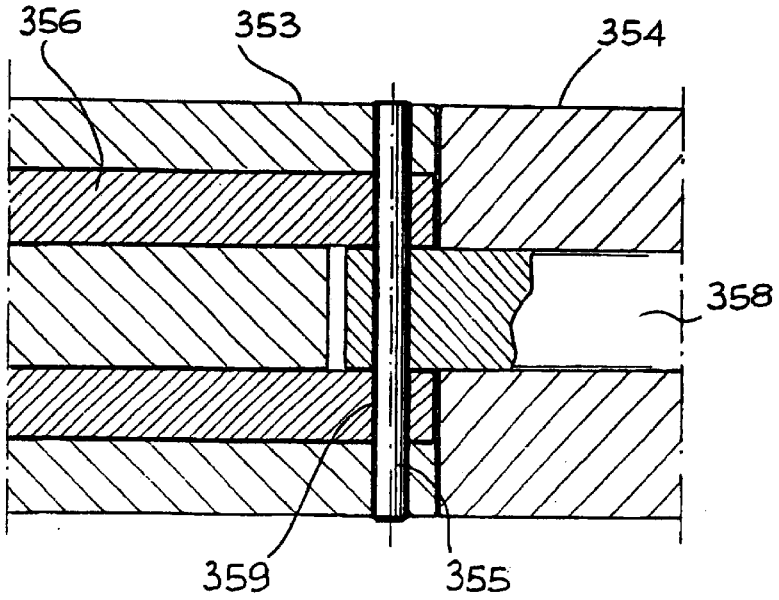
Figure 11:
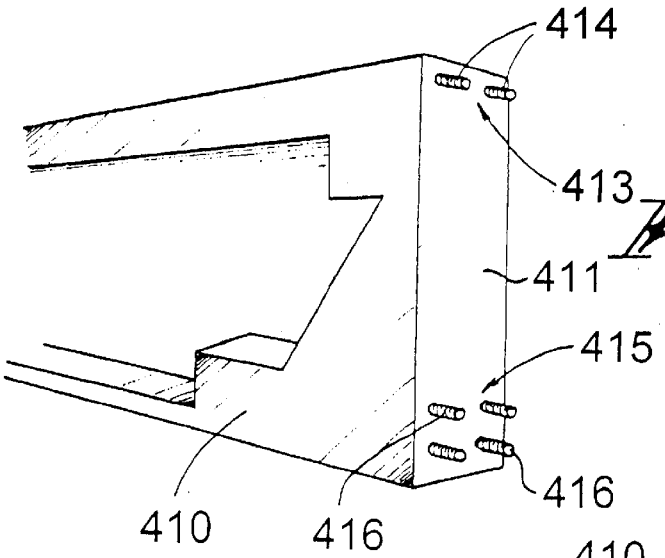
FIG. 11 shows a perspective of part of one half-girder for the formation of a roof structure according to the invention.

In the example in FIGS. 9 and 10, the girder is still formed by two half-girders 333, 334, but the connection to the adjacent ends is achieved by means of joint plates and at least one pivot pin or cross bolt 355.

Then, there are at least two parallel plates 356, standing apart and with a hollow 357 between them. The other half-girder incorporates and anchors at least one protruding plate 358, which is designed to be inserted into the hollow 357 between the two plates 356 of the half-girder 353. The plates 356 and 358 have holes 359 which are aligned with one another and with a hole in the half-girder 353. Thus, when the half-girders are brought together, the pivot pin or cross bolt 355 is simply threaded through said holes 359 to connect them together and complete the girder, ready for use. It should be noted that a half-girder can also be equipped with pins or end prongs 360 to be inserted into corresponding holes 361 in the adjacent end of the other half-girder, to help line up the two half-girders at the moment of their assembly.

In the version in FIGS. 11–17, number 410 indicates a typical half-girder, prefabricated in reinforced concrete for use in making roof structures as described in the invention.

The half-girder 410 is made in a corresponding mould, has a near end 411 and a far end, and may have a flat intrados and a flat or sloping extrados.

It has its respective reinforcement—not shown—to which it is bound by means of the appropriate stirrups, at least two upper metal bars 413, each of which have an end 414 protruding from the near end 411, near the extrados, and at least a couple of lower bars 415, each of which have an end 416 protruding from the near end, but near the intrados. The ends 14, 16 of the bars 413, 415 are threaded in such a way as to be able to screw at least one blocking nut 417 onto each one.

Figure 14:
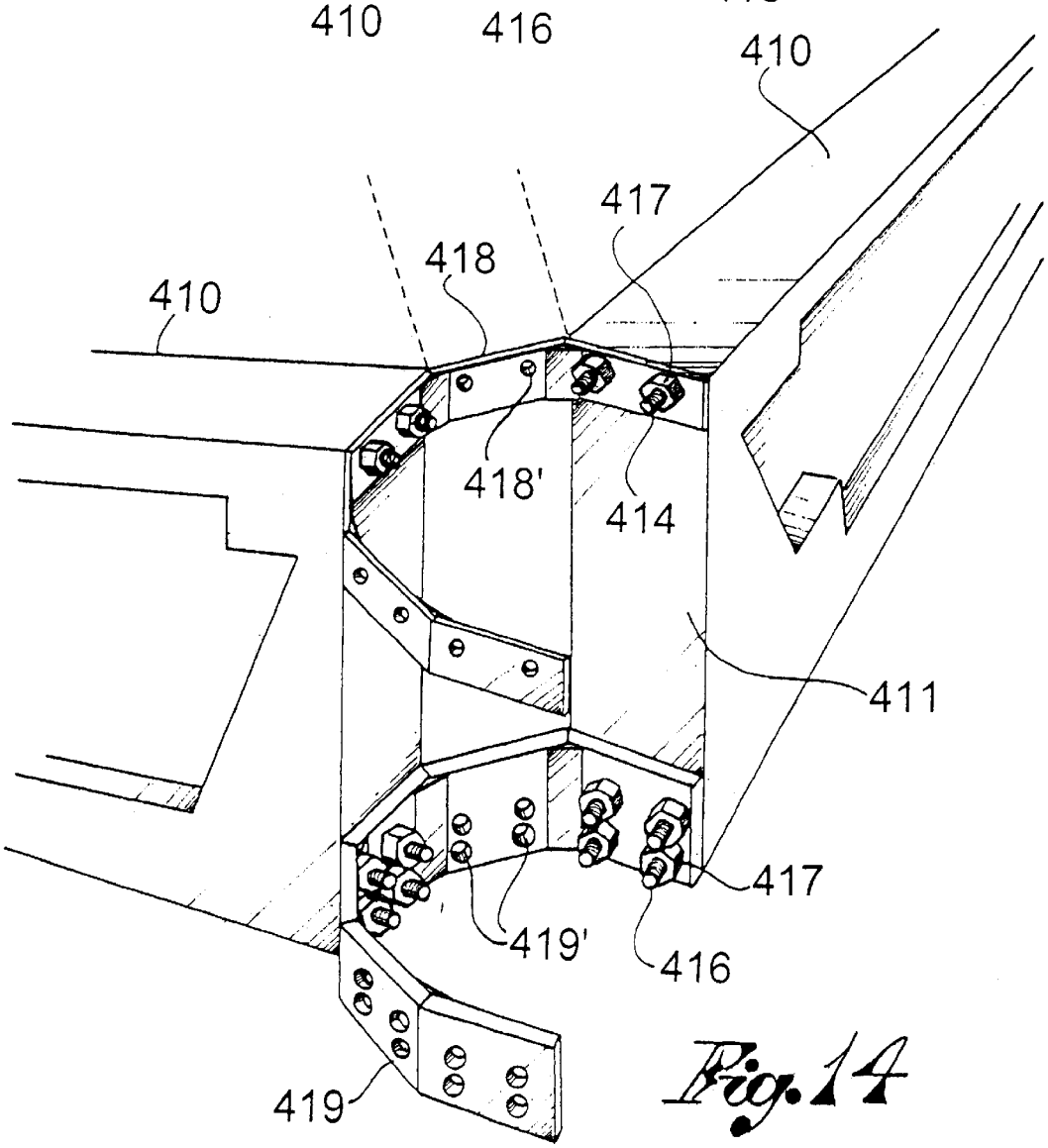
FIG. 14 shows the connection of some of the girders to these ring elements.
Figure 15:
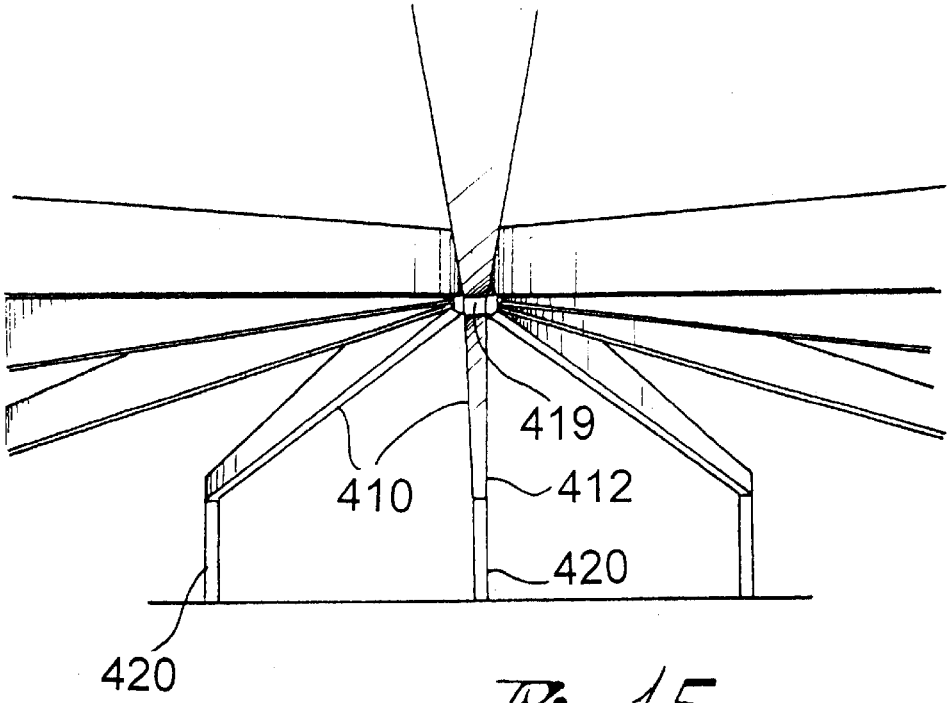
FIG. 15 shows the system of girders in a roof structure like that in FIG. 12, from below.

In order to create a roof structure with a polygonal shape, as shown in FIG. 12, it is necessary to use half-girders 410 placed in sunburst formation and with their near ends 411 fixed to central ring elements 418, 419, consisting of plates reinforced with additional gussets and having as many sides as there are half-girders used—FIGS. 13 and 14.

One ring element 418 is placed at the top, at the level of the upper bars 413 of the half-girders and has holes 418' to allow the traded ends 414 of said bars to pass through; a second ring element 419 is located at the bottom, at the level of the lower bars 415 and has holes 419' to receive the ends 416 of these bars.

In this way, the near ends 411 of the half-girders 410 are fixed to the central rings 418, 419 by means of safety nuts 417, which are screwed onto the threaded ends of the connecting rods 413, 415. Meanwhile, the far ends 412 of the girders are made to rest on pillars 420, thereby creating the formation of the girders for the roofing required—FIG. 15.

Figure 16:
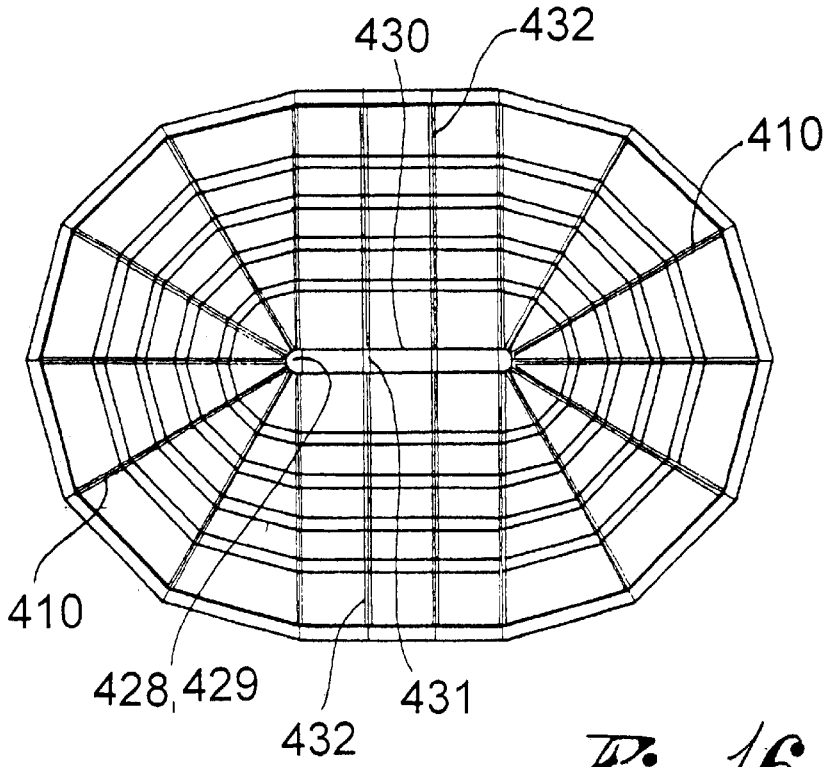
FIG. 16 shows a plan of the layout of the girders in a roof structure with an elliptical form.

Similarly, the same half-girders 410 can be used to build roof structures with an elliptical shape, as shown in FIG. 16, for example.

Figure 17:
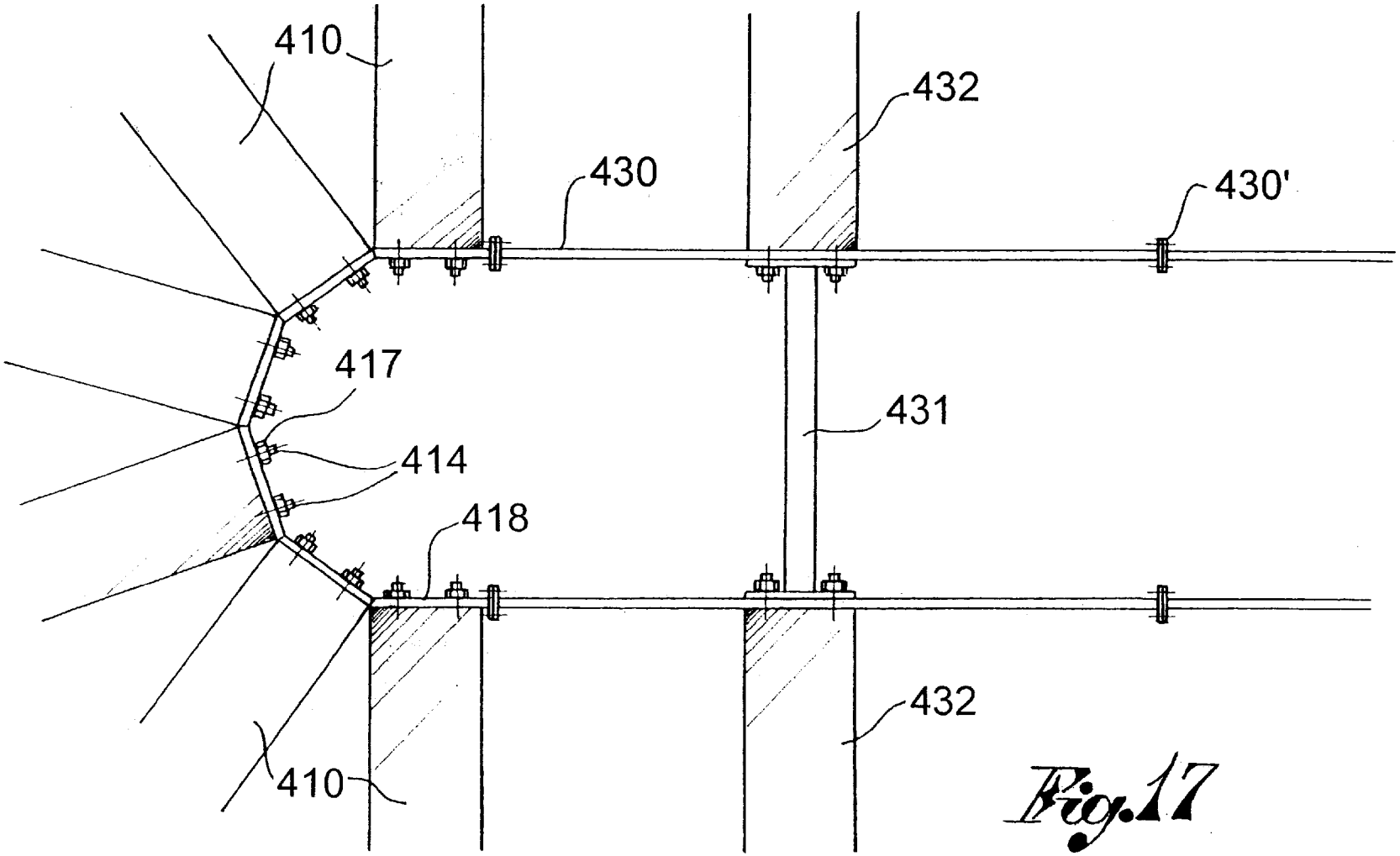
FIG. 17 show the connection of several girders within a structure such as that shown in FIG. 16.

The near ends of some of the half-girders 410 placed in sunburst formation are therefore fixed in the same way to semicircular elements 428, 429—FIG. 17.

These are connected lengthwise by means of continuous stringer plates 430, which can be as long as required and which are joined cross-ways by buttresses 431, which are also stringer plates.

The stringers 430 may be formed by various plates joined together by means of bolted head plates 430', and they have holes for receiving the threaded ends of the connecting axes 413, 415 of the half-girders 432 placed in parallel between them, in the space between the two groups of half-girders in sunburst formation fixed at either end in the semicircular elements 428, 429.

I claim:

1. A girder in reinforced cement with a flat intrados and a flat or sloping extrados, characterized by the fact of its being composed of two symmetrical halves or first and second half-girders with adjacent parts meeting in a plane mid-way which is perpendicular to the intrados and equipped, near the extrados, with connecting plates for bolting and, near the intrados, with a joint device with bars parallel to said intrados;

each half-girder having its own ordinary reinforcement, characterized by the fact that each half-girder has the connecting plate near to the extrados anchored to the ordinary reinforcement by means of reinforcing bars and equipped with various holes for blocking bolts and where the joint device near the intrados includes;

one or more metal bars at a front and rear of the first half-girder which are bound by stirrups to the ordinary reinforcement of the first half-girder and where each bar ends in a protruding sleeve with an internal thread that protrudes partially towards the second half-girder;

a tubular lining and a coupling tube in the second half-girder which are aligned and tied to the ordinary reinforcement of said second half-girder by means of stirrups, and where the coupling tube faces and is ready to receive the protruding sleeve in the first half-girder once the two girder halves are brought together, and second bars which pass into said tubular linings, each having a threaded end which screws into a sleeve in the first half-girder and an opposite end equipped with a tightening nut which rests against a blocking plate fixed to said linings and resting against one of a plurality of solid shoulders of the second half-girder.

2. Girder according to claim 1, in which the second bars and respective tightening nuts are accessible via a cavity located in the second half-girder, which can be filled in after assembly.

3. A girder according to claim 1, in which the girder is T-shaped or H-shaped, with one or two ribs, respectively, at the intrados and a sill for the extrados, and where the connected plates for bolting are at a level of the extrados sill and the joint device with bars is at the level of the one or more intrados ribs.

4. A girder in reinforced cement with a flat intrados and a flat or sloping extrados, characterized by the fact of its being composed of two symmetrical halves or half-girders with adjacent parts meeting in a plane mid-way which is perpendicular to the intrados and equipped, near the extrados, with connecting plates for bolting and, near the intrados, with a joint device with bars parallel to said intrados;

each half-girder has an ordinary reinforcement, characterized by the fact that in each half-girder the connecting plate near the extrados is anchored to the ordinary reinforcement by means of reinforcement bars and equipped with holes to receive blocking bolts, and where the joint device near the extrados includes;

a tubular lining in each half-girder which, together with a coupling tube is aligned with those of the other half-girder when the two halves are brought together for joining, and joint bars which pass through the aligned tubular linings of the two half-girders and which have tightening nuts at their opposite ends, said nuts resting against a blocking plate and accessible via cavities which are located in the two half-girders and can be blocked up after assembly.

5. A girder in reinforced cement with a flat intrados and a flat or sloping extrados, characterized by the fact of its being composed of two symmetrical halves or half-girders with adjacent parts meeting in a plane mid-way which is perpendicular to the intrados and equipped, near the extrados, with connecting plates for bolting and, near the intrados, with a joint device with bars parallel to said intrados;

each half-girder having a respective ordinary reinforcement, characterized by the fact that in each half-girder the connecting plate near the extrados is anchored to the ordinary reinforcement by means of reinforcement bars and equipped with holes to receive blocking bolts, and where the joint device near the intrados includes;

a tubular lining in each half-girder which, together with a coupling tube aligns with those of the other half-girder when the two halves are brought together for joining, and stranded cords which pass through said aligned tubular linings and are anchored at one end to a blocking plate and tautened from the other end with cone-shaped clamps accessible via a cavity located in the half-girders that is closed after assembly.

6. A girder assemble comprising:

first and second girders including cement and reinforcement in said cement, said first and second girders having an intrados and an extrados, said first and second girders having adjacent ends and being substantially symmetrical about said adjacent ends, said adjacent ends meeting in a plane which is substantially perpendicular to the intrados;

a plurality of sleeves in said cement of each of said girders, said plurality of sleeves being connected to said reinforcement of said girders, said sleeves being substantially parallel to said intrados;

a plurality of bars arranged in said plurality of sleeves;

a blocking plate arranged in said second girder spaced from said end of said second girder, said blocking plate being arranged adjacent said intrados, each of said bars extending from one of said sleeves of said first girder through one of said sleeves of said second girder and fixed to said blocking plate of said second girder.

7. An assembly in accordance with claim 6, wherein:

another plurality of bars are arranged in said first girder, said plurality of bars and said another plurality of bars being threaded into said sleeves of said first girder, said another plurality of bars being directly connected to said reinforcements of said first girder;

a plurality of nuts on said plurality of bars, each of said plurality of bars are anchored to said blocking plate by one of said plurality of nuts being threaded onto one of said bars.

8. An assembly in accordance with claim 6, wherein:

a plurality of nuts on said plurality of bars, each of said plurality of bars are anchored to said blocking plate by one of said plurality of nuts being threaded onto one of said bars;

another blocking plate is arranged in said first girder spaced from said end of said first girder, said another blocking plate being arranged adjacent said intrados;

another plurality of nuts, each of said plurality of bars being anchored to said another blocking plate by one of said another plurality of nuts being threaded onto respective ones of said bars.

9. An assembly in accordance with claim 6, wherein:

a plurality of cone-shaped clamps on said plurality of bars, each of said plurality of bars are anchored to said blocking plate by one of said plurality of cone-shaped clamps being clamped onto one of said bars.

* * * * *